United States Patent [19]

Cohen

[11] Patent Number: 5,069,212

[45] Date of Patent: Dec. 3, 1991

[54] BIOMECHANICAL ORTHOTIC WITH CONVERTIBLE INSERTS

[75] Inventor: Lee S. Cohen, Bryn Mawr, Pa.

[73] Assignee: The Dr. Cohen Group, Inc., N.J.

[21] Appl. No.: 380,590

[22] Filed: Jul. 17, 1989

[51] Int. Cl.[5] ..... A61F 5/14

[52] U.S. Cl. ..... 128/615; 128/586; 128/602

[58] Field of Search ..... 128/581, 583, 584, 585, 128/586, 596, 601, 602, 614, 615; 36/43–44

[56] References Cited

U.S. PATENT DOCUMENTS

| | | | |
|---|---|---|---|
| 51,968 | 1/1866 | Plumer . | |
| 2,505,032 | 4/1950 | De Voos . | |
| 3,469,576 | 9/1969 | Smith . | |
| 4,510,700 | 4/1985 | Brown . | |
| 4,603,698 | 8/1986 | Cherniak | 128/581 |
| 4,688,338 | 8/1987 | Brown . | |
| 4,747,410 | 5/1988 | Cohen . | |
| 4,841,648 | 6/1989 | Shaffer et al. | 128/586 |

OTHER PUBLICATIONS

Letter to Editor, The Journal of American Podiatric Medical Assn.; vol. 78, No. 2, Feb. 1988 from Howard J. Dananberg.

Article, The International Journal of Sport Biomechanics, vol. 4, 1988, authored by B. M. Nigg and H. A. Bahlsen.

*Primary Examiner*—Richard J. Apley
*Assistant Examiner*—Lynne A. Reichard
*Attorney, Agent, or Firm*—Leydig, Voit & Mayer

[57] ABSTRACT

A podiatric orthosis composed of a material having a selected density and compressibility incorporating a biomechanically operative region which defines an aperture operative to receive plug inserts of a density and compressibility different from that of the orthosis for altering the biomechanical function of the orthosis in the region of the plug insert.

4 Claims, 2 Drawing Sheets

BIOMECHANICAL ORTHOTIC WITH CONVERTIBLE INSERTS

TECHNICAL FIELD

This invention relates to the field of podiatric orthosis and, more particularly, to a biomechanically configurable orthosis incorporating convertible insert modules for permitting customization of the biomechanical function of the orthosis.

BACKGROUND OF THE INVENTION

The origin of this invention is traceable to U.S. Pat. No. 4,747,410 issued May 31, 1988 to the inventor herein. For that reason, the content of that patent is incorporated herein by reference.

It is axiomatic that each person is an individual and that problems associated with each differs. As such, the particular biomechanical requirements of each depends on both individual characteristics and the degree of the existing problem. For purposes of illustration, the example of biomechanical and kinesiological aspects of a sprained ankle is first discussed.

One of the most common injuries to the lower extremities is the sprained ankle, a sprain being a wrenched or twisted joint. The major components of the ankle joint are the distal ends of the tibia and fibula bones of the leg and the talus bone of the foot. These bones are bound by the medial and lateral collateral ligaments. A sprain constitutes a trauma manifested as straining or rupturing to these ligaments. On page 177 of *DuVrie's Surgery of the Foot,* edited by Verne T. Inman, M.D., Ph.D., and published by The C. V. Mosby Co. in 1973, the nature of an ankle strain is described.

In normal locomotion (walking or running), the thrust of the body weight is transmitted from the leg into the talus, distributed through the foot and, finally, impacts on the supporting surface. If, during locomotion, the foot suddenly turns laterally, an abnormally large horizontal body-weight force vector is created. Generally, this force vector is directed laterally through the lateral collateral ligaments; the Anterior Talofibular Ligament, the Posterior Talofibular Ligament, the Anterior Inferior Tibiofibular Ligament and the Calicaneofibular Ligament. Lateral forces and trauma sustained by these ligaments are referred to as inversion. If the horizontal force is directed medially through the Deltoid Ligament, which occurs less frequently than lateral injuries, it is known as eversion. Since the body weight is abnormally directed to one of the ankle sides, it is not properly transferred through the foot. Such abnormally directed horizontal force, when sufficiently strong, overcomes the ligament structure resulting in a sprain or rupture. Certain naturally occurring congenital foot deformities such as a forefoot varus tibial varum or rearfoot inversion, all of which promote inversion of the ankle joint, augment the probability of and can exacerbate ankle sprains.

Among the conventional treatments for ankle sprains are the use of a rearfoot wedge; this wedge being elevated on the lateral aspect to artificially form a rearfoot eversion. Biomechanically, the eversion promoted by the rearfoot wedge assists to prevent laterally directed ankle sprains. Unfortunately, the use of a rearfoot wedge can create or augment excessive pronation syndrome and the associated adverse physiological problems. Furthermore, reliance solely on a rearfoot wedge deprives the user of direct control over the ankle joint itself. Finally, use of a static single action rearfoot wedge while adequate in many cases, does not permit variable progressive treatment of an ankle sprain or strain. The ankle trauma version of the present invention is intended to overcome the disadvantages of the rearfoot wedge and provide for direct control over the inversion or eversion of the ankle joint.

Another commonly encountered foot injury involves heel spurs. Heel spur syndrome is caused by plantar fascial injuries developed from excess tensioning or pulling stress by the plantar fascia on the calcaneus. As a result, the membrane surrounding the calcaneus (periosteum) becomes inflamed. Since the periosteum has osteoblastic properties, the inflamed area ultimately calcifies and forms a sharp bony protuberance. The protuberance not only has the capability to traumatize but may develop sufficiently to cut surrounding soft tissue. Given the adverse effect of pronation on the plantar fascia, it follows that excessive pronation augments the stress on the periosteum. As the subtalar joint pronates, which in turn results in elongation of the foot, the plantar fascia stretches and creates corresponding tensioning of the plantar fascia.

Full treatment of heel spurs generally involves surgery. However, if attended to in the early stages, the development of periosteum inflammation and the corresponding spur formation can be halted. Thus, surgery, required for the more aggravated cases, can be avoided.

SUMMARY OF THE INVENTION

It is an object of this invention to provide a biomechanically configurable podiatric orthosis and methods directed to assisting or overcoming foot problems.

It is another object of this invention to provide a method and a convertible orthosis employing insert modules operative in a specific manner required by need.

Still another object of this invention is to provide a method and apparatus allowing for customization of the functional characteristics of a biomechanical orthosis.

Another object of this invention is to provide a removable orthotic shoe insert and method overcoming and biomechanically compensating for defects in locomotion.

Yet another object of this invention is to provide an insertable pad for a shoe with insertable plugs of differing characteristics for progressively changing the biomechanical function of the pad.

It is still another object of this invention to provide an orthotic pad with inserts of differing density for alleviating pain associated with ankle trauma such as a sprain or heel spurs.

These and other objects of this invention are satisfied by a biomechanically configured orthosis for assisting in normal foot function during locomotion, comprising:

compressible and resilient means for. underlying the foot posterior of the metatarsal parabola, said means defining an aperture underlying at least one biomechanically operative region, and a replaceable plug means having desired density and compressibility characteristics for inserting into said aperture for modifying the biomechanical function of the region, said plug means being dimensioned to conform with and be insertable in said compressible and resilient means aperture, whereby the selection of said plug means governs the biomechanical function of the orthosis relative to the biomechanically operative region.

Still other objects of this invention are satisfied by a method for progressively changing the biomechanical function of an orthotic, comprising the steps of:

providing a pad of selected density and compressibility of a length sufficient to underlie the foot from the heel to the metatarsal parabola, providing an aperture in the pad corresponding to a biomechanically operative region of the foot, providing an insert dimensionally conforming to the aperture and having a density and compressibility differing from that of the pad to modify the biomechanical function of the foot in that region.

Further objects of this invention are satisfied by an orthotic insert, comprising:

a pad formed of thermoset polymeric foam and being compressible and resilient, said pad being dimensioned to underlie the plantar surface of the foot and incorporating antipronation means including a forefoot varus wedge, an arch support and a heel cup, said pad further incorporating two apertures remotely spaced and disposed medially and laterally of the pad's longitudinal bisector in the posterior section of said heel cup, and insert means for forming a supportive cradle for the Calcaneus medial tubercle, said insert means conforming to the dimensions of said apertures and having selected density and compressibility characteristics for reducing tension of the plantar fascia on the Calcaneus.

In the context of the present invention relative to ankle joint trauma, sprains and the like, a purpose of the present invention is to stabilize the foot in the vertical plane to prevent additional inversion or eversion to the ankle joint while maintaining proper biomechanical functions of the entire foot during the gait cycle. To prevent inversion, the more common form of ankle sprain, the invention contemplates use of a compressible material, e.g. foam thermoplastic, where the densities underlying the medial and lateral aspects of the ankle joint differ. The more compressible, lower density material is located in a medial column intended to underlie the ankle joint. The lateral aspect, in contrast, is constructed of higher density, less compressible material. This arrangement urges the ankle joint to roll medially (evert), thereby minimizing inversion. Since the ankle trauma, generally, heals progressively, the need for medial urging progressively lessens. This invention employs the feature of convertible plug inserts for the medial column to accommodate the progressive aspects of healing.

The insert comprising the medial column is removable from the pad and replaceable with a substitute insert; initially formed of a material of lowest density and greatest compressibility and subsequently higher density and lesser compressibility. Thus, the invention contemplates series of inserts providing progressively higher (or lower, if applicable) densities compared to that of the surrounding pad. The range of pad densities enhances control over the degree of eversion and thus allows for a corresponding progressively lessened horizontal stabilizing effect. Use of the invention, therefore, assists in the healing process as well as allowing the ankle joint to regain its strength.

Promoting eversion, however, is not a panacea for ankle health. While this invention minimizes inversion by encouraging the ankle joint to roll medially, the same forces have a tendency to cause the foot to pronate excessively. To accommodate the pro-pronatary aspects of eversion and to combat its undesirable effects on the foot, an ankle sprain version of the invention contemplates incorporation of a heel cup, arch support and a forefoot varus wedge.

Although the most common form of ankle sprain involves the lateral ligaments, given their inherent weakness relative to the medial ligaments, medial ankle sprains do occur. The present invention can accommodate medial trauma merely by converting the medial column to a lateral column or by using initially a more dense medial column insert than that of the surrounding orthotic region and progressively decreasing the density to parity with that of the orthotic. This encourages inversion to accommodate a medial ankle sprain. Given the principles, set forth above, it should be evident that this arrangement would urge the ankle joint laterally. Since additional pronation would not be induced, in this case, the anti-pronation components, i.e., heel cup, arch support and varus wedge, need not be altered since they comprise benign elements of the insert.

Turning now to a heel spur version of the invention, it features four biomechanically significant components, three of which are defined in the inventor's above-identified patent. Those components are a heel cup, a medial arch support region, a forefoot varus wedge and the fourth, a heel lift and cradle. All are fashioned from resilient, compressive cushioning material although of differing density and compressibility. The heel lift and cradle contemplated for mitigating heel spur development and minimizing the associated pain are formed by inserting plugs of higher density and less compressibility than the immediately surrounding areas and disposed medially and laterally of the heel cup bisector. Biomechanically, the inserts serve to elevate the heel during locomotion causing, in turn, a slight plantarflexion of the foot and raising of the median arch. Hence, the plantar fascia is shortened and tension thereon reduced correspondingly. The cradle developed between the medial and lateral inserts, composed of a softer (more compressible-less dense) material protects the more sensitive area of the calcaneus medial tubercle, the distal origination of the plantar fascia.

DETAILED DESCRIPTION OF THE ILLUSTRATED EMBODIMENTS

Figure 1:
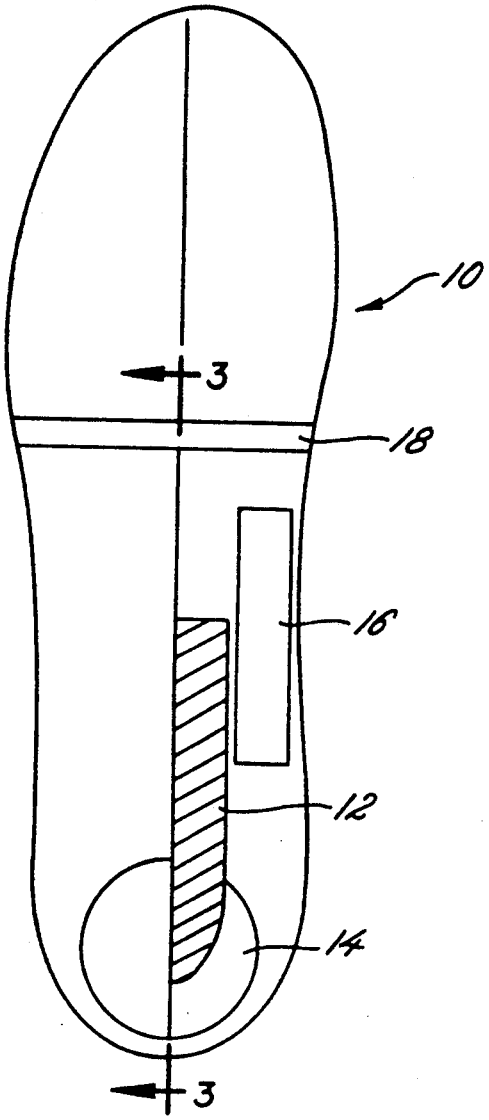
FIG. 1 is a schematic top view of an embodiment of the invention.

Referring now to FIG. 1, it represents orthotic pad insert 10 for use with a laterally directed sprain. As noted above, much of the structure of pad insert 10 originates in the invention described in U.S. Pat. No. 4,747,410 issued on May 31, 1988 to Dr. Cohen, the inventor hereof. Consequently, the content of that patent is incorporated herein by reference.

To encourage the ankle joint to evert and compensate for the resulting excess pronation, the embodiment of the invention employs four biomechanically significant components. These components are medial column 12 located directly under the ankle joint, heel cup 14 surrounding the subcalcaneal fat pad, arch support 16 (medial shelf) underlying the first metatarsal bone, and forefoot varus wedge 18 at the metatarsal heads. Heel cup 14, arch support 16 and varus wedge 18 are schematically illustrated but are not necessarily visible in pad 10. Only insert 12 is necessarily visible.

Figure 2:
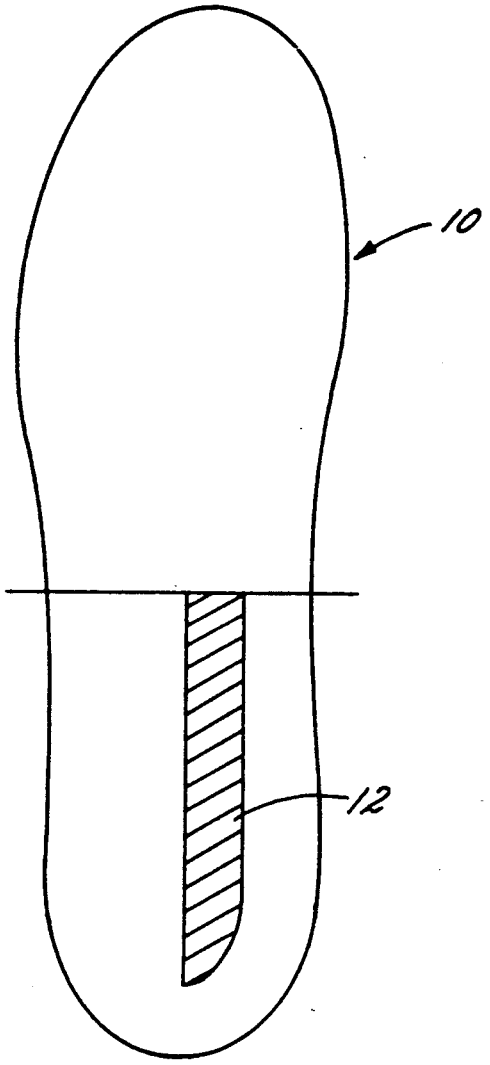
FIG. 2 is a schematic top view of the medial column in the embodiment.
Figure 3:
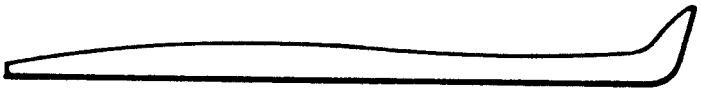
FIG. 3 is a cutaway longitudinal view of the heel cup bisector of the embodiment of FIG. 1.

The dimensions and placement of the components in relation to pad insert 10, in reference to a size 5 men's (size 7 women's) shoe, for example, are now described. Medial column 12, as illustrated in isolation in FIG. 2, is located by inverting the insert and bisecting the heel cup perimeter. Commencing 1.27 cm (½ inch) from the posterior wall of the heel cup and widening parabolically to 1.58 cm (⅝ inch), the medial column extend anteriorly 10.47 cm (4 ⅛ inches). Medial column 12 thereby constitutes a removable plug insert relative to pad 10. The thickness of medial column 12 conforms to that of the surrounding pad region material. Heel cup 14, generally integrated with pad insert 10, when sectioned along its bisector, possesses an overall height of approximately 2.14 cm (27/32 inch) and extends anteriorly 4.44 cm (1 ¾ inches). A tracing along the bisector of cup 14 is depicted in FIG. 3.

Figure 4:
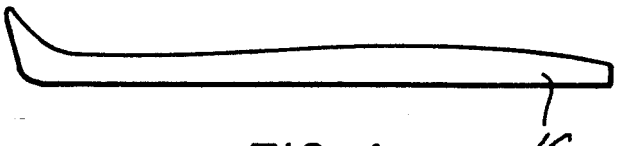
FIG. 4 is a cutaway longitudinal view along a line medially displaced 11/16 inch from the bisector.

Arch support 16 illustrated in FIG. 4, begins longitudinally 7.14 cm (2 13/16 inches) from the posterior wall of the heel cup. It is transversely offset from the heel cup bisector by approximately 1.74 cm (11/16 inch). The rearward portion of arch support 16 maintains a 0.95 cm (⅜ inch) thickness but the support begins to diminish in thickness approximately 12.7 cm (5 inches) anterior to the posterior heel cup wall.

Figure 5:
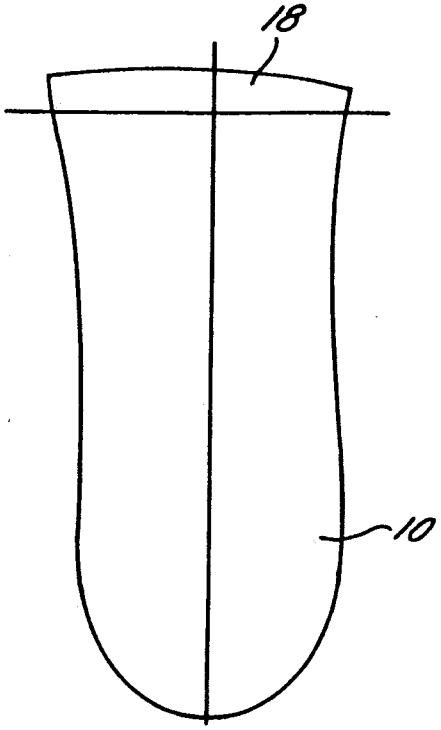
FIG. 5 is a partial view defining the location of the varus wedge.

Finally, referring to FIG. 5, forefoot varus wedge 18 commencing 1.43 cm (9/16 inch) posterior to the metatarsal parabola and extending anteriorly approximately 0.47 cm (3/16 inch), transversely, diminishes in thickness from about 0.47 cm (3/16 inch) on the medial side (underlying the first metatarsal bone) to 0.31 cm (⅛ inch) on the lateral side. The diminution in thickness establishes a wedge possessing a 3 degree diminishing transverse slope from the medial to lateral sides.

Pad insert 10, in accordance with this invention, must accommodate the biomechanics of the foot during locomotion. The selection of the material component of pad 10 necessarily provides an important contribution to the function of the pad insert. More particularly, the material must be compressible and resilient in order to provide a functional degree of cushioning and resistance. One such material is the closed cell foam thermoplastic Plastazote PO78$^{TM}$, available from United Foam Plastics, Inc. of Georgetown, Massachusetts. Among the more important physical characteristics, apart from durability and moisture resistance, are the density and cushioning properties of Plastazote PO78$^{TM}$. The density of the material, prior to thermosetting, ranges from 0.070–0.090 gm/cm$^3$ (4.4 to 5.5 lb/ft$^3$). Measured density after the Plastazote is thermoset is approximately 0.11 gm/cm$^3$. (6.4 lb/ft$^3$). The thermosetting process reduces the material volume to about one-half of the original thickness. After the thermosetting step, the 50% compression load deflection is 9.2–13.2 gm/cm$^2$ (19–27 lb/ft$^2$) (ASTM - 3574-81).

Alternatives to Plastazote PO78 include Trocellan ZJV500 or Laminated Trocellan XJV500. Both Trocellan materials are available through Dynamit Noble Corporation of South Holland, Illinois.

The replaceable plug comprising medial column 12 can be formed from the following materials possessing the designated physical characteristics:

Plastazote P2101:
Density=0.024 g/cm$^3$ (1.5 lb/ft$^3$)
50% compression load deflection=15 lb f/in$^2$ Plastazote P3202:
Density=0.033 g/cm$^3$ (2.1 lb/ft$^3$)
50% compression load deflection=20 lb f/in$^2$ Plastazote P4068:
Density=0.044 g/cm$^3$ (2.8 lb/ft$^3$)
50% compression load deflection=24.7 lb f/in$^2$ Other materials include the equivalent of Plastazote P3203 (density=0.024 g/cm$^3$); Dow 200 LC Ethafoam and Plastazote P3203 0.034 gm/cm$^2$ (density=2.1 lb/ft$^3$) can be replaced with Dow Ethafoam (0.035 g/cm$^3$ density). Likewise, Plastazote P4068 0.045 gm/cm$^3$ (density=2.8 lb/ft$^3$) can be replaced with Trocellan Foam, (0.048 g/cm$^3$) which is available through Dynamit Nobel Corporation of South Holland, Illinois.

From the foregoing it should now be evident that the density and compression load deflection properties of each of the materials are of great importance in order to satisfy the intended function of the plug insert.

Moving briefly to manufacturing processes, they are of a conventional nature. The plug insert, in this case column 12, is produced by conventional techniques, as for example, where a sheet of 1.27 cm (½ inch) thick Plastazote PO78 is placed in a convection oven, with both top and bottom heating, at a temperature range between 171° C. (340° F.) and 204° C. (400° F.). Once the desired thermosetting temperature is achieved, the thermoset sheet is removed and placed in a mold dimensioned to conform to an orthotic pad of desired size and features. The mold is closed with a pressure from 350 to 700 g/cm$^2$ (5–10 lb/in$^2$) and a closing speed between 100 and 1,000 cm/min (40–400 in/min). The molded pads are then removed and cooled.

Heat molding the Plastazote sheet is a viable alternative to the above. The sheet is placed directly in the molding tool and subjected to a closing pressure of up to 2800 g/cm$^2$ (40 lb/in$^2$). The molding tool itself is heated by appropriate means to 160° C. That temperature is maintained for approximately 10 minutes for every 0.25 cm thickness of material. The finished insert, as above, is cooled, removed from the mold and the excess material is trimmed.

Once the body of the insert is formed, it is necessary to cut out the region of the medial columns with an appropriately formed press. The cut out region, preferably, extends through the entire thickness of the pad. It may, however, retain a section of the lower pad to form a nest for the plug. The medial and lateral columns themselves may be press cut from a blank of suitable material using an appropriately dimensioned press without any thermosetting process.

Figure 6:
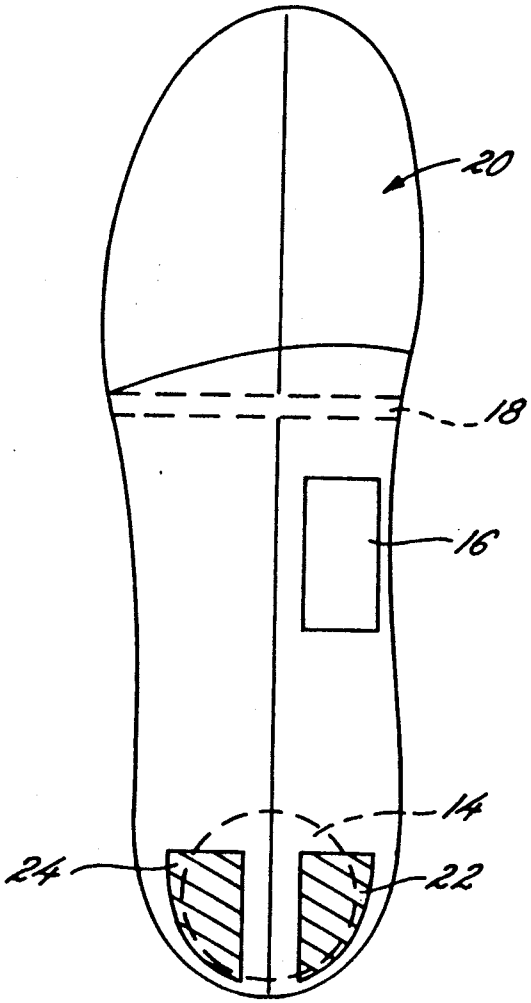
FIG. 6 is a schematic top view of another embodiment of an invention for heel spurs.

Moving to the second embodiment of the invention in FIG. 6, its use is intended to mitigate the adverse effects of heel spurs. In this case, pad 20 incorporates the integrated antipronation components; wedge 18, medial shelf 16 and heel cup 14. Disposed 0.95 cm (3 ⅛ inches) on the medial side from the longitudinal bisector is medial plug insert 22 and 0.95 cm on the lateral side, lateral plug insert 24. In the case of a size 5 pad insert plugs 22 and 24 commence at the extreme posterior of the plantar surface and extend 2.54 cm (1 inch) anteriorly from the heel cup wall. To conform most easily to the pad configuration and the heel cup wall, the outer edges of inserts 22 and 24 are arcuate. Both plug inserts compose a portion of the heel cup and, thus, possess a thickness corresponding to that of the surrounding pad material. However, their density is greater than that of the surrounding material, i.e., 0.11–0.13 g/cm$^3$ (thermoset density). Plastazote H9062 or Trocellan XJW600 foam are examples of materials possessing these necessary characteristics. Processing is similar to that described above. Also, in reference to the ankle trauma embodiment, the inserts may be packaged to provide customization of the orthotic in the form of differing insert densities. Accordingly, the degree of elevation can be selected. The less compressible the insert, the more stable the cradle (elevation) and the greater the support provided to the calcaneus medial tubercle. Furthermore, progressive reduction of the density of inserts 22 and 24 allows for the return to an effectively uniform pad density over time.

Figure 7:
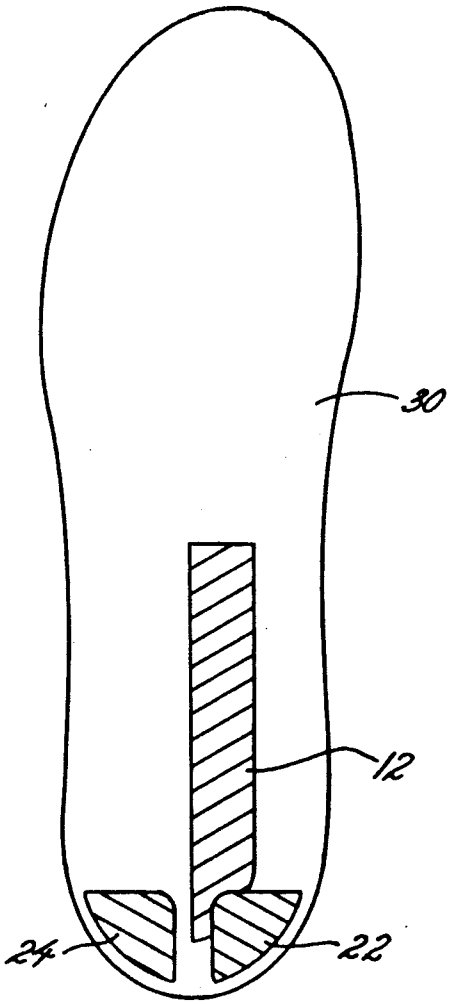
FIG. 7 is a schematic top view of a third embodiment combining the ankle sprain and heel spur embodiments.

In FIG. 7, hybrid pad 30 is illustrated to underscore the broad spectrum of potential combinations of the insert plug invention. Pad 30 is an antipronatary orthotic, like those described above, which differs from the above-described embodiments by combining the special insert plugs of both. This embodiment would be readily employable when both conditions, ankle trauma and heel spurs, are present. Medial column 12 possesses the same characteristics identified above but may incorporate a cut out portion at the posterior end to accommodate insert 22. While the configuration of this third embodiment is illustrated, it is not intended to restrict the invention to any specific set of conditions or geometry. So long as the biomechanically functional attributes of selected insert plugs are present, the particular form that they take is not intended to be limited to the specifically identified conditions.

Many variations and modifications of the above-described embodiments are within the ordinary skill of the skilled artisan in this art, without departing from the scope of the invention. Accordingly, those modifications and embodiments are intended to fall within the scope of the invention as defined by the following claims:

I claim:

1. An orthotic insert, comprising:

a pad formed of thermoset polymeric foam and being compressible and resilient, said pad being dimensioned to underlie the plantar surface of the foot and incorporating antipronation means including a forefoot varus wedge, an arch support and a heel cup, said pad having a plantar and lower surfaces and defining an aperture interrupting the continuity of and formed in said plantar surface, said aperture being medially disposed of the pad's longitudinal bisector and extending through the pad region operative to underlie an ankle, and insert means for progressive alteration of the biomechanical function of the pad relative to the forefoot, and insert means conforming to the dimensions of said aperture to form the portion of said plantar surface corresponding to said aperture and having selected density and compressibility characteristics for modifying the degree of biomechanical functional alteration of the orthotic.

2. A method for progressive treatment of ankle trauma, comprising the steps of:

(a) providing a compressible and resilient antipronation orthosis having a plantar and lower surfaces and configured to underlie the plantar surface of a foot, the orthosis having a heel cup, an arch support, a forefoot varus wedge, and an aperture of selected dimensions for interrupting the continuity of the plantar surface, where the aperture is medially disposed relative to the longitudinal bisector of the orthosis and underlying the ankle joint, (b) providing insertable plug modules dimensioned to conform to the aperture to form the portion of said plantar surface corresponding thereto, the plug modules having selected compressibility and resilience different from that of the pad to alter the biomechanical operability of the pad on the ankle joint in a diminishing manner, (c) inserting the plug module into the aperture to establish a substantially continuous plantar surface where the plug module is operative to alter the biomechanical function of the pad to the greatest degree, and (d) removing the plug module and substituting a similarly dimensioned plug module having a biomechanically operative function of a lesser degree than the removable plug module.

3. A method for progressive treatment of heel spurs, comprising the steps of:

(a) providing a compressible and resilient antipronation orthosis having a plantar and lower surfaces and configured to underlie the plantar surface of a foot, the orthosis having a heel cup, an arch support, a forefoot varus wedge, and at least two remotely spaced complementary apertures in the heel cup one disposed medially and one laterally of the longitudinal bisector of the orthosis in the heel cup region where the apertures interrupt the continuity of the plantar surface, (b) providing a first set of insertable plugs composed of a greater density and lesser compressibility than the orthosis where the plugs are dimensioned to correspond to the apertures to establish a substantially continuous plantar surface when the plugs are inserted, (c) establishing a cradle for the calcaneus medial tubercle by inserting the plugs into the apertures, (d) providing a second set of insertable plugs similarly dimensioned to but having a density less than that of the first set and greater than that of the orthosis, (e) removing the first set of insertable plugs, and (f) substituting the second set of insertable plugs for the first set.

4. A biomechanically configured orthosis for assisting in normal foot function during locomotion, comprising:

antipronation biomechanical elements including a transverse forefoot varus wedge, a medial shelf for underlying the first metatarsal and a heel cup, compressible and resilient means for underlying the foot posterior of the metatarsal parabola, where said compressible and resilient means is composed of a thermoset closed cell polymeric foam and has a plantar and lower surfaces and two apertures, remotely spaced from each other in the posterior region of the heel cup, one each on the medial and lateral sides of the longitudinal bisector of the orthosis, two replaceable plug means corresponding to said apertures each being composed from a denser and less compressible material than the heel cup, a third aperture located on the medial side of the bisector underlying said ankle joint where said two plug means form a cradle to support the calcaneus medial turbercle, and third plug means of greater density and lesser compressibility than the surrounding portions of the orthosis to induce inversion of the foot to avoid medial ankle trauma, where said plug means are dimensioned to conform with and be insertable in said compressible and resilient means aperture and form the portion of said plantar surface corresponding to said apertures, whereby the selection of said plug means governs the biomechanical function of the orthosis relative to the biomechanically operative region.

* * * * *